United States Patent [19]

Kobayashi et al.

[11] Patent Number: 5,039,094

[45] Date of Patent: Aug. 13, 1991

[54] GAME MACHINE

[75] Inventors: Hiroyuki Kobayashi, Ichikawa; Shukuo Ishikawa, Tokyo; Hiroki Nakahata, Yokohama; Masaki Koenuma; Yoshihiro Mieda, both of Tokyo, all of Japan

[73] Assignee: Namco, Ltd., Tokyo, Japan

[21] Appl. No.: 547,408

[22] Filed: Jul. 2, 1990

Related U.S. Application Data

[63] Continuation of Ser. No. 385,770, Jul. 26, 1989, abandoned.

[30] Foreign Application Priority Data

Aug. 3, 1988 [JP] Japan ..... 63-102383[U]

[51] Int. Cl.[5] ..... A63F 9/00

[52] U.S. Cl. ..... 273/441; 273/454

[58] Field of Search ..... 273/1 GC, 1 GE, 1 GG, 273/130, 369, 370; 272/76

[56] References Cited

U.S. PATENT DOCUMENTS

| | | | |
|---|---|---|---|
| 4,224,761 | 9/1980 | Wakimura | 273/330 X |
| 4,353,545 | 10/1982 | Anderson | 272/76 |
| 4,461,475 | 7/1984 | Nakamura | 273/1 GC |

FOREIGN PATENT DOCUMENTS

| | | | |
|---|---|---|---|
| 542375 | 4/1956 | Italy | 273/369 |
| 47-5991 | 2/1972 | Japan | 273/1 GE |
| 1407496 | 7/1988 | U.S.S.R. | 272/76 |

OTHER PUBLICATIONS

Play.meter, vol. 12, No. 18, 10/15/1986, p. 47, Whac A Mole.

*Primary Examiner*—Paul E. Shapiro

*Attorney, Agent, or Firm*—Jordan and Hamburg

[57] ABSTRACT

A game machine includes a number of movable assemblies, a storing portion for storing the movable assemblies and a mechanism for reciprocating the movable assemblies between a home position inside the storing portion and a turning position outside the storing portion. Each of the movable assemblies is in the form of an animal and includes a pair of members simulating respective jaws of the animal. One of the jaw members is povitally supported relative to the other for simulating opening and closing a mouth of the animal and a mechanism applies a biasing force for pivoting the first mentioned jaw member away from the other jaw member thereby to simulate opening of the mouth. The first mentioned jaw member by external application of force thereto is pivotably toward the other jaw member against the biasing force, whereby the open mouth is closed when the player hits the first mentioned jaw member by a hammer brought down by the player in a direction transversely intersecting the moving direction of the assembly. A hitting sensor detects closing of the mouth effected by the aforementioned hitting and thereupon effects registration of a score and returning of the assembly to the home position.

1 Claim, 4 Drawing Sheets

GAME MACHINE

This is a continuation of application Ser. No. 385,770, filed Jul. 26, 1989, abandoned

FIELD OF THE INVENTION AND RELATED ART STATEMENT

The present invention relates to a game machine and, particularly, to a game machine in which a plurality of movable assemblies are provided and a player scores a point every time he succeeds in hitting one of the movable assemblies upon movement thereof.

As one known game machine of such type, there is a game machine which includes a panel formed with a plurality of holes through each of which a movable member associated therewith is thrust out at random and a player scores a point every time he succeeds in hitting the thrust out movable member with a hammer or the like.

In such conventional game machine, the movable members are moved vertically of the panel through the holes formed therein and the direction of hitting by the player is in direct opposition to the moving direction of the movable member. Therefore, it is enough for the player to select an exposed member and hit it. Since such is relatively easy, the amusement provided thereby is relatively slight.

OBJECT AND SUMMARY OF THE INVENTION

In view of the above problem, an object of the present invention is to provide a game machine of the general type mentioned but in which the amusements of the game is increased by making conditions under which a player can hit a movable member more complicated.

The above object can be achieved according to the present invention by a game machine of a type which includes a plurality of movable members in the form of movable assemblies and in which a player scores a point at the time he hits any of the movable members when it is moved, comprising a storing portion for storing the movable members, means for reciprocating each of the movable members between a home position inside the storing portion and a predetermined turning position outside the storing portion and a hitting sensor for detecting one of the movable members which is moved outwardly at least partially beyond the storing portion and hit by a hammer brought down by the player in a direction transversely intersecting the moving direction of the one movable member, whereby a score of points is obtained on the basis of a detection result of the hitting sensor.

In one aspect of the present invention, each of the movable members takes the form of animal having an openable portion corresponding to a mouth and each point of score is obtained at the time the openable portion is closed by hitting.

In another aspect of the present invention, the openable portion is opened and shut during the movement thereof toward the predetermined turning position.

In a further aspect of the present invention, a distance between the home position and the predetermined turning position is made variable.

The moving direction of the hammer transversely intersects the moving direction of the movable member. Thus, the position of a portion of the movable member to be hit is varied with respect to the player, so that a proper hitting of the movable member by the player becomes more difficult, resulting in greater amusement.

The moving means for moving the movable members may be a combination of a rack and a pinion or may be any other driving means The movable member may take any configuration. However, it is preferrable that the hit portion thereof is constituted such that, when it is hit, it deforms and presents a visual interest to the player. For example, it is possible to form the hit portion as an animal head having a mouth which opens gradually with an outward movement thereof and closes when hit by the player.

Further, it is preferrable to control the distance between the home and the predetermined turning positions such that it is shortened at least once during reciprocal movements of the movable member. In such case, it is possible to return the movable member toward the home position before it reaches the turning position estimated by the player. Thus, a feinted motion of the movable member is provided.

DETAILED DESCRIPTION OF THE PREFERRED EMBODIMENT

Figure 1:
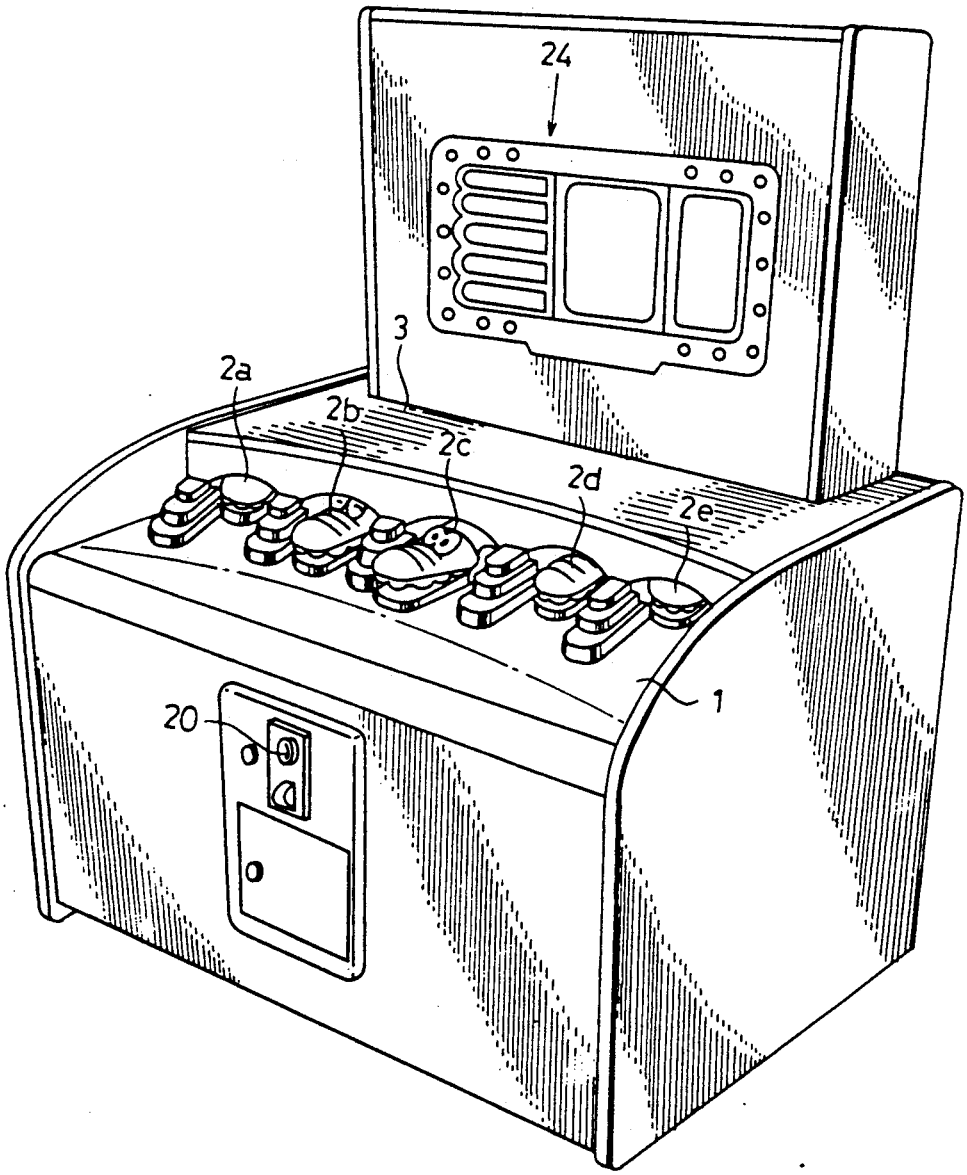
FIG. 1 is a perspective view of an embodiment of a game machine according to the present invention.

FIG. 1 is a perspective view of a game machine according to an embodiment of the present invention. In FIG. 1, a plurality (five in this embodiment) of movable members 2*a*, 2*b*, 2*c*, 2*d* and 2*e* are arranged on a game table 1. In this embodiment, each movable member takes the form of crocodile. An upper panel 3 is provided above a rear portion of the game table 1 and a movable member storing portion 4 is defined between the upper panel 3 and the rear portion of the game table 1. The movable members 2*a*, 2*b*, 2*c*, 2*d* and 2*e* are normally in respective home positions within this storing portion 4, as shown in FIG. 2.

Figure 2:
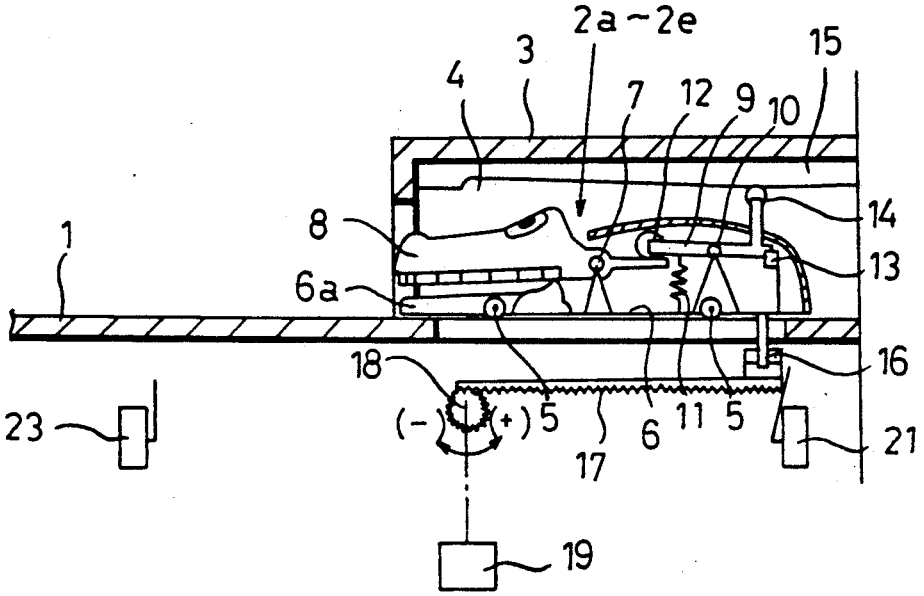
FIGS. 2 to 5 are cross sectional side views of a movable member, respectively, showing a movement thereof.

In FIG. 2, each of the movable members 2*a* to 2*e* is composed of a base member 6 having rolls 5 and movable on the game table 1, a hit portion 8 in the form of a crocodile head arranged on a left or front end portion of the base member 5 and a fallen "L" shape lever 9 provided on a right or rear end portion of the base member 6 rotatably about a support shaft 10. The hit portion 8 is swingable vertically about a support shaft 7. A spring 11 is provided between the base member 6 and a horizontal leg portion of the L lever 9 to bias the latter in counterclockwise direction so that a front end and a rear end of the lever 9 are brought always into contact with a rear end of the hit portion 8 and a cam 15 provided on a lower surface of the upper panel 3 through rolls 12 and 14, respectively. The surface configuration of the cam 15 includes a flat front portion, a rear flat portion and a gradually changing intermediate portion between them, so that a vertical position of the roll 14 in contact therewith is low when the movable member is in its home position, rises gradually when it is moved forwardly and becomes low again abruptly when it reaches the predetermined turning position. A border between the rear flat portion and the gradually changing portion is stepped sharply so that the lever 9 is rotated clockwisely sharply to thereby realize the abrupt positional change of roll 14. An optical sensor 13 is fixedly provided on the rear end portion of the base member 6 as a sensor for detecting an open and close operation of the hit portion 8.

A lower surface of the rear portion of the base member 6 is coupled through a connecting member 16 to a rack 17 which meshes with a pinion 18 provided beneath the front portion of the base member 6. The pinion 18 is driven by a reversible motor 19.

Figure 5:
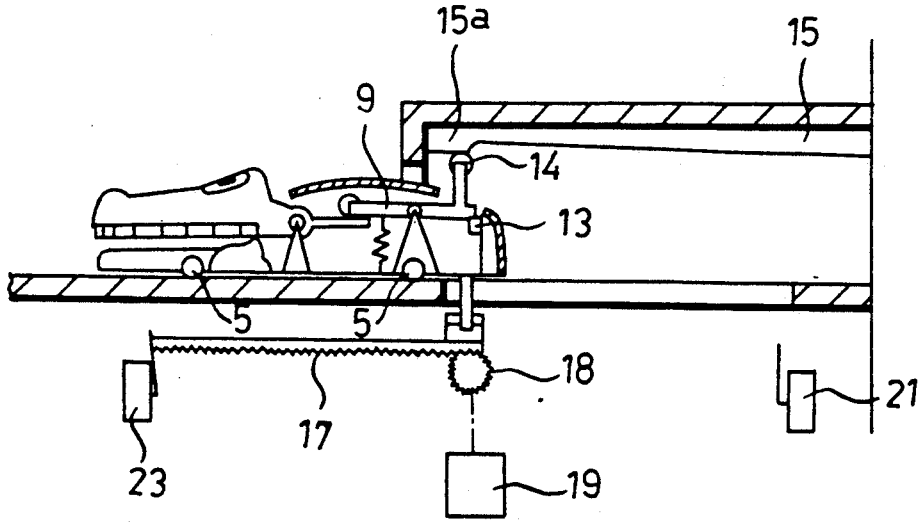
Figure 6:
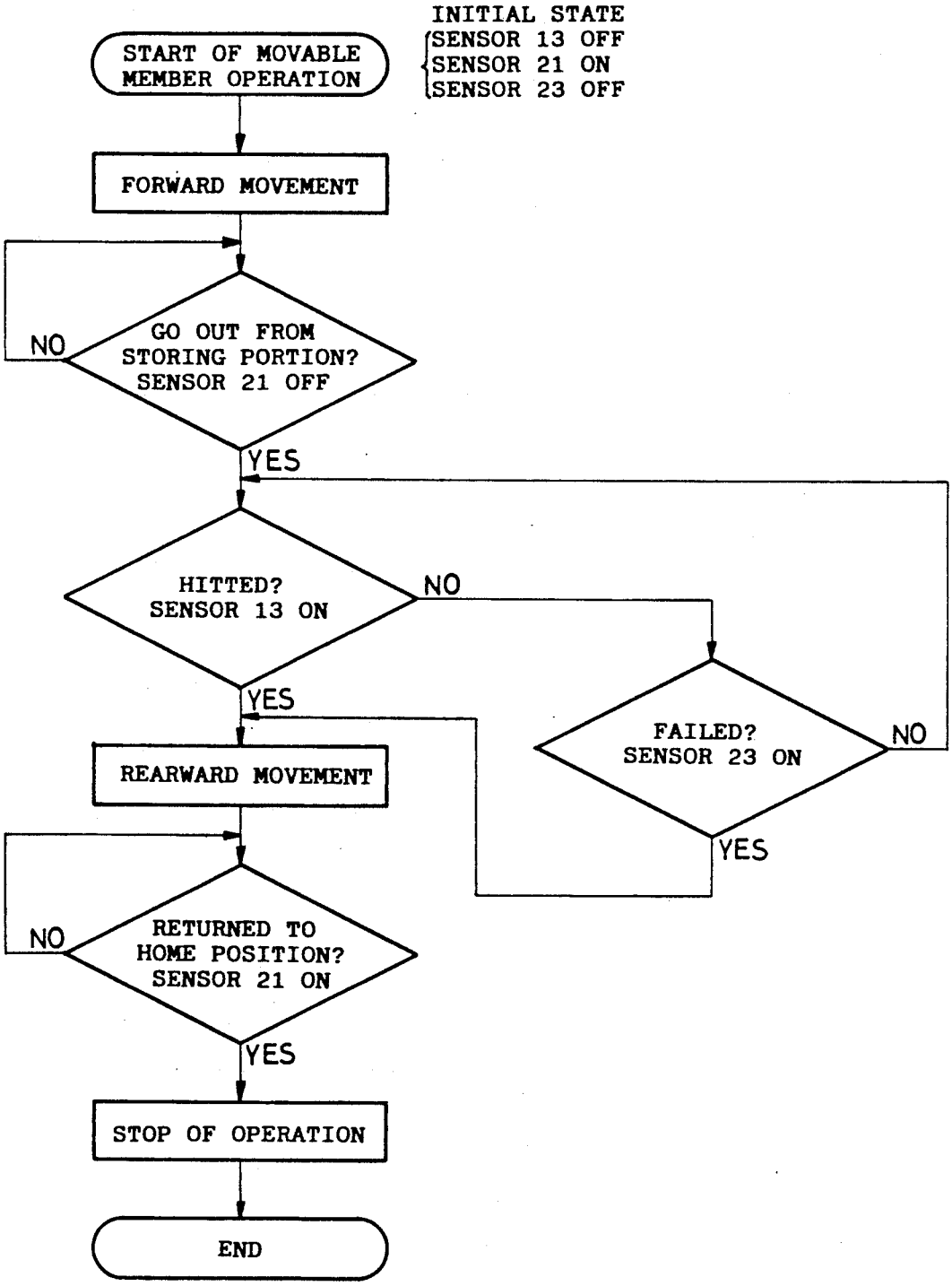
FIG. 6 is a flowchart showing an example of control thereof.

An operation of the movable members 2*a* to 2*e* will be described with reference to FIGS. 2 to 5 together with a flowchart shown in FIG. 6. Since the movable members are identical in configuration and operation, the operation of only one movable member will be described. It should be noted, however, that operation timings of the respective movable members can be determined at random in any well known manner.

The game machine shown in FIG. 1 is brought into a ready state when a coin is thrown into a coin inlet 20 thereof. The motor 19 is actuated in one direction at a suitable timing after the initialization of the game machine to rotate the pinion 18 in counterclockwise direction. With this counterclockwise rotation of the pinion 18, the rack 17 is moved forwardly. With this forward movement of the rack 17, the associated movable member starts to move forwardly or outwardly from a home position in the storing portion 4. The start of movement of the movable member is detected by a home position sensor 21 which may comprises a micro switch.

Figure 3:
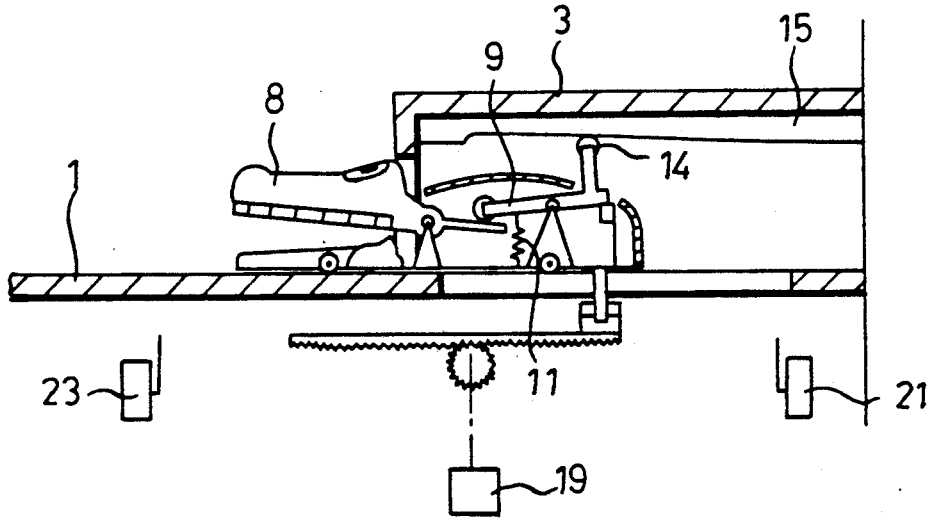

When the movable member is moved forwardly gradually from the home position shown in FIG. 2, with the roll 14 tracing the gradual portion of the cam 15, the movable member appears on the exposed portion of the game table. During this movement of the movable member, the lever 9 is allowed by the biasing spring 11 to rotate in counterclockwise direction gradually to gradually open the hit portion 8, i.e., a mouth of the crocodile, as shown in FIG. 3.

Figure 4:
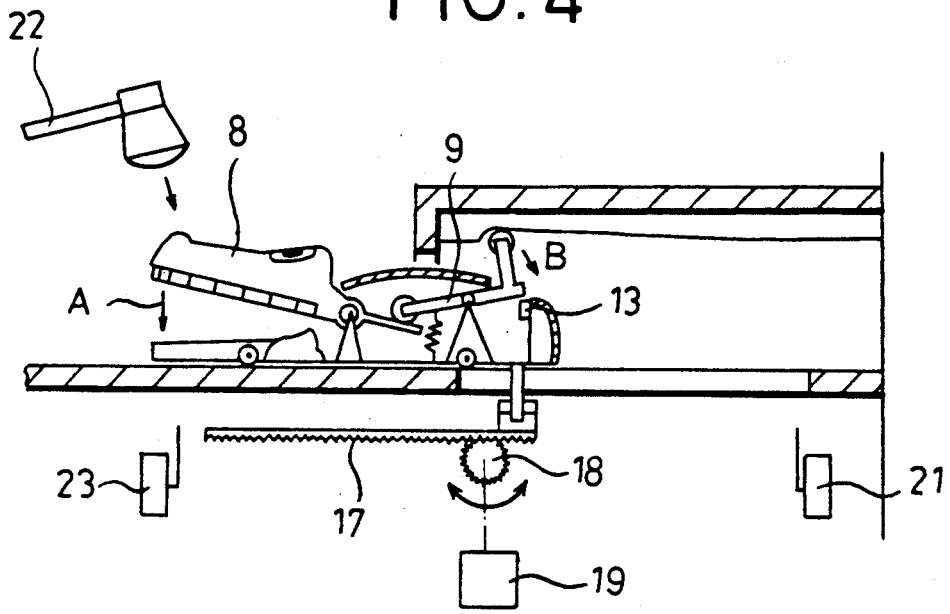

A player will bring his hammer 22 down to hit the opened hit portion 8, as shown in FIG. 4, and, if he succeeds to hit it, he will score a point. When he succeeds to hit, the crocodile mouth is shut down as shown by an arrow A, so that the lever 9 is rotated clockwise direction as shown by an arrow B in FIG. 4, which is detected by the sensor 13. Upon detection of hitting, it is displayed on a display 24 shown in FIG. 1. This display may be an addition of point number. At the same time, the motor 19 is driven in the reverse direction to rotate the pinion 18 in clockwise direction to thereby retract or return the movable member to the home position in the storing portion 4. When the movable member reaches the home position, it is detected by the home position sensor 21 upon which the motor 19 is deenergized.

It is not always possible for the player to hit the hit portion 8 of the movable member when the latter is in a position in which it can be hit. When he fails to hit, the movable member continues to move forwardly until an end of the rack 17 reaches the predetermined turning position and the fact is detected by the turning position sensor 23, as shown in FIG. 5. Upon detection of the turning position sensor 23, an addition of a loss or damage point is displayed on the display 24 or a subtraction of a point from success points on the display 24 is performed.

When the movable member reaches the turning position to be detected by the turning position sensor 23, the roll 14 of the lever 9 rides on the front flat portion 15*a* of the cam 15, so that the hit portion 8 is closed and the fact is detected by the sensor 13. Thereafter, the movable member is moved in the opposite direction to the home position in the storing portion 4.

Alternatively, it is possible to make the turning position changeable under a control of a computer such that the movable member is turned before it reaches the predetermined turning position. In such case, a feinted motion is given to the movable member causing difficulty of hitting it to be increased and hence the amusement provided the game to be improved.

What is claimed is:

1. A game machine comprising a plurality of movable assemblies, a storing portion for storing the movable assemblies, means for reciprocating the movable assemblies between a home position inside said storing portion and a turning position outside said storing portion, each of the movable assemblies being in the form of an animal and including a pair of members simulating respective jaws of the animal, means for pivotally supporting one of the members relative to the other for simulating opening and closing a mouth of the animal, and means for applying a biasing force for pivoting said one member away from the other member thereby to simulate opening of the mouth, said one member by external application of force thereto being pivotable toward said other member against the biasing force, whereby the open mouth is closed when the player hits said one member by a hammer brought down by the player in a direction transversely intersecting the moving direction of said assembly, and a hitting sensor for detecting closing of the mouth effected by said hitting and for thereupon effecting registration of a score and returning of the assembly to the home position.

* * * * *